US011634829B2

(12) United States Patent
Mann et al.

(10) Patent No.: US 11,634,829 B2
(45) Date of Patent: Apr. 25, 2023

(54) METHOD FOR PRODUCING ALUMINUM ALLOYS

(71) Applicant: OBSHCHESTVO S OGRANICHENNOY OTVETSTVENNOST'YU OBEDINENNAYA KOMPANIYA RUSAL INZHENERNO-TEKHNOLOGICHESKIY TSENTR, Krasnoyarsk (RU)

(72) Inventors: Viktor Khrist'yanovich Mann, Moscow (RU); Aleksandr Olegovich Gusev, Krasnoyarsk (RU); Dmitriy Aleksandrovich Simakov, Krasnoyarsk (RU)

(73) Assignee: OBSHCHESTVO S OGRANICHENNOY OTVETSTVENNOST'YU "OBEDINENNAYA KOMPANIYA RUSAL INZHENERNO-TEKHNOLOGICHESKIY TSENTR", Krasnoyarsk (RU)

( * ) Notice: Subject to any disclaimer, the term of this patent is extended or adjusted under 35 U.S.C. 154(b) by 0 days.

(21) Appl. No.: 16/478,469

(22) PCT Filed: Nov. 24, 2016

(86) PCT No.: PCT/RU2016/000816
§ 371 (c)(1),
(2) Date: Jul. 16, 2019

(87) PCT Pub. No.: WO2018/097744
PCT Pub. Date: May 31, 2018

(65) Prior Publication Data
US 2020/0024760 A1 Jan. 23, 2020

(51) Int. Cl.
*C25C 3/06* (2006.01)
*C22C 21/02* (2006.01)

(52) U.S. Cl.
CPC ..... *C25C 3/06* (2013.01); *C22C 21/02* (2013.01)

(58) Field of Classification Search
CPC ..... C25C 3/06–3/24
See application file for complete search history.

(56) References Cited

U.S. PATENT DOCUMENTS 3,507,643 A 4/1970 McMinn et al.
3,508,908 A * 4/1970 Ernest ..... C25C 3/06 75/681

(Continued)

FOREIGN PATENT DOCUMENTS

CN 1254624 A 5/2000
CN 1896331 A 1/2007

(Continued)

OTHER PUBLICATIONS

International Search Report of PCT/RU2016/000816 by the International Searching Authority (ISA/RU), dated Aug. 24, 2017. (Original Russian and English translation).

(Continued)

*Primary Examiner* — Ciel P Contreras
(74) *Attorney, Agent, or Firm* — Baker & McKenzie LLP

(57) ABSTRACT

The invention relates to production of alloys based on aluminum. A method is proposed for producing aluminum-based alloys by electrolysis, according to which low-consumable anode of aluminum pot is used as a source of alloying elements. At the same time, in order to optimize master alloy consumption, one of the following options is chosen: dissolution of alloying elements from slightly soluble anodes; adding oxides and/or fluorides and/or carbonates of alloying elements to electrolyte melt of aluminum pot; simultaneous dissolution of alloying elements from slightly soluble anodes with addition of oxides and/or fluorides and/or carbonates of alloying elements to electrolyte melt of aluminum pot. The method comprises the following stages: introducing alloying elements into molten cathode aluminum by dissolving them in electrolyte melt of aluminum pot from low-consumable anode and/or by adding oxides/and fluorides and/or carbonates of alloying elements into electrolyte melt of aluminum pot; reduction of alloying elements introduced into electrolyte melt of aluminum pot (Continued)

Figure 1:
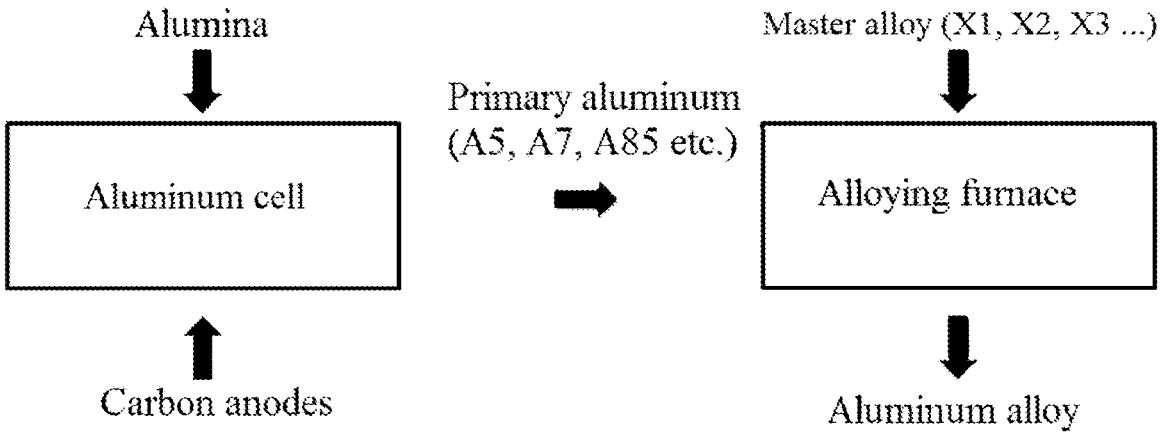
PRIOR ART FIG. 1

on molten cathode aluminum to form the base for aluminum alloys; determining percentage of elements in the base for aluminum alloys; and bringing alloys to a given composition by adding alloying elements to the base for aluminum alloys in the required amount. The result is multicomponent aluminum alloys of a given composition with introduction of alloying admixtures in the process of aluminum production by electrolysis, and then the alloy is brought to a predetermined composition, providing simplification of technology and control, reducing master alloy consumption which leads to lower cost of aluminum alloy production.

5 Claims, 2 Drawing Sheets

(56) References Cited

U.S. PATENT DOCUMENTS

| | | | | |
|---|---|---|---|---|
| 3,980,537 | A | 9/1976 | McMinn et al. | |
| 4,600,481 | A * | 7/1986 | Sane | C25C 3/16 205/382 |
| 4,882,017 | A * | 11/1989 | Weaver | C22C 1/00 205/363 |
| 8,992,661 | B2 | 3/2015 | Jha et al. | |
| 2001/0013474 | A1 * | 8/2001 | De Nora | C25C 3/12 205/188 |

FOREIGN PATENT DOCUMENTS

| | | | | |
|---|---|---|---|---|
| CN | 103361502 | A | 4/2015 | |
| CN | 105648246 | A * | 6/2016 | |
| EP | 3075875 | A1 * | 10/2016 | C22C 1/026 |
| RU | 2401327 | C2 | 10/2010 | |
| RU | 2599475 | C1 | 10/2016 | |
| SU | 707996 | A1 | 1/1980 | |

OTHER PUBLICATIONS

International Written Opinion of PCT/RU2016/000816 by the International Searching Authority (ISA/RU), dated Aug. 24, 2017. (Original Russian and English translation).

International Preliminary Report on Patentability of PCT/RU2016/000816 by the International Preliminary Examination Authority (IPEA/RU), dated May 28, 2019. (Original Russian and English translation).

* cited by examiner

METHOD FOR PRODUCING ALUMINUM ALLOYS

FIELD OF THE INVENTION

The invention relates to non-ferrous metallurgy, namely, to alloying of aluminum.

BACKGROUND OF THE INVENTION

For production of aluminum alloys, aluminum made by electrolysis of oxyfluoride melts is commonly used. Aluminum master alloys of a given composition and a given amount are added to the resulting aluminum, thus, the required chemical composition of the alloy is achieved. Aluminum alloys from electrolytic aluminum are produced by adding master alloy with a concentration of alloying elements X1, X2, X3 . . . to alloying furnace. For example, aluminum alloy for type 8011 foil production is obtained by adding master alloys containing Si, Fe, Ti, B to grade A5, A7, or A8 aluminum. Production of aluminum alloys in such way requires aluminum with a low level of admixtures. In turn, for electrolytic production of aluminum, this requirement imposes a limit on admixtures content in raw materials entering the pot and in material of carbon anode to be consumed, i.e. aluminum production requires high-quality raw materials. It is also necessary to take into account the fact that high cost of master alloys affects the cost of aluminum alloy.

Thus, there is a need to reduce the cost of aluminum alloy.

One of the ways to reduce the cost of alloy is to produce alloys or aluminum with high content of alloying elements directly in aluminum pot.

There is a method of aluminum alloys production using carbon anodes with high alloying components content [U.S. Pat. No. 8,992,661, IPC C25C3/06, C25C3/26, published on Mar. 31, 2015]. The method consists in using carbon anodes with high content of alloying elements for aluminum alloy in specific group of pots. This method allows using low-quality anodic raw materials with high admixtures content for production of aluminum, and at the same time to reduce cost of aluminum alloy by cutting master alloy consumption in further process of preparing aluminum alloy. The disadvantage of this method is limited content of useful alloying element in electrolytic aluminum (for example, achievable concentration of vanadium in aluminum is 0.1 to 0.25%), as well as negative impact of low-quality raw materials on such characteristics of carbon anodes as electrical conductivity.

There is a method of production of Al—Si aluminum alloys in the process of electrolysis [U.S. Pat. No. 3,980,537, IPC C25C3/36, C22C21/02, published on Sep. 14, 1976]. The method consists in using a mixture of alumina and silicon oxide during electrolysis of aluminum. To prevent formation of insoluble sediment consisting of sodium and aluminum silicates, in this method it is necessary to periodically cause the so-called "anode effect" by stopping feed of raw materials into the pot. This technique is a disadvantage of the method, since the anode effect is accompanied by emissions of $CF_4$ and $C_2F_6$ greenhouse gases and increased pot voltage.

There is a method of production of Al—Ti aluminum alloys in the process of electrolysis [U.S. Pat. No. 3,507,643, IPC C22C21/00, C22B3/12, C25C3/36 published on Apr. 21, 1970]. The method consists in the fact that titanium-containing and aluminum-containing raw materials (for example, a mixture of titanium-containing bauxites or clays and alumina) are fed into the pot to produce aluminum containing titanium in the range of 0.3-2%. Thereafter, the obtained aluminum is maintained at a temperature of 700-750° C. to obtain an intermetallic phase with titanium concentration of more than 10%, followed by mechanical separation of solid and liquid phases. The disadvantage of this method is an increased contamination of aluminum-titanium alloy with admixtures (Fe and Si) from titanium-containing bauxites or clays and, therefore, limited applicability of Al—Ti alloy. Another disadvantage of the method is accumulation of solid titanium-aluminum-silicon compound at the bottom of the pot, which is only removed after pot stopping.

There is a method for production of boron-containing aluminum alloys in aluminum pots by adding boron-containing compounds to anode paste [USSR author's certificate No. 707996, IPC C25B11/12, C25C3/36, published on Jan. 5, 1980]. This method allows aluminum to be alloyed with boron by anodic dissolution of boron in electrolyte, followed by reduction of boron ions on liquid aluminum cathode, which is converted into Al—B alloy as a result of this process. The disadvantage of this method is an increased electrical resistance of anode leading to increased power consumption.

INVENTION SUMMARY

The method for producing aluminum alloys by electrochemical method [Patent RU 2401327, IPC C25C3/36, published on Oct. 10, 2010] is the closest, in technical terms, to the proposed invention. The method involves introducing into molten cathode aluminum alloying elements from a slightly soluble anode by dissolving it in potassium/sodium cryolite-alumina melt and reducing alloying elements in the molten cathode aluminum. As a slightly soluble anode, a metal alloy or metal-ceramic or ceramic material with alloying elements content of 2-97 wt. % is used. Tin, nickel, iron, copper, zinc, chromium, cobalt are used as alloying elements. The disadvantage of this method is that when implementing this method in an industrial environment it is impossible to obtain many known and popular alloys, it is difficult to maintain concentration of all alloying elements coming from a slightly soluble anode into aluminum in a given range for the corresponding alloy. This is evident from the examples given in the prototype. For example, it is impossible to obtain alloys containing titanium, silicon, and magnesium, which are usually not introduced into composition of slightly soluble anodes, since they have a strongly negative electrochemical potential and increase anodes corrosion. This leads to an increase in dissolution rate of all alloying elements from anode and, consequently, to an increase in their concentration in the resulting aluminum alloy. In addition, it is impossible to ensure for a long time the required concentration of all alloying elements in multicomponent aluminum alloys containing more than two components. It should be noted that almost all used aluminum alloys are multicomponent. The following factors hinder preparation of multicomponent alloys of stable composition using the known method.

Firstly, during operation of a slightly soluble anode, alloying elements enter electrolyte based on the following mechanism: 1) dissolution of element or its compounds in electrolyte→2) recovery of element from melt on liquid cathode aluminum→3) dissolution of alloying element in aluminum. Of these three processes, at least the process speed (1) is different for different elements and, moreover, constantly changes over time. This is due to the fact that the rate of receipt of each of alloying elements significantly depends on their electrochemical potential and oxygen affinity, diffusion coefficient of the element in anode, solubility of the alloying element and its compounds in electrolyte, process temperature, alloying element concentration in anode and in electrolyte, and ionic composition of electrolyte. These parameters are different and differently affect oxidation and removal of various elements from anode. The more components there are in an aluminum alloy, the more difficult it is to ensure transition of elements from anode to aluminum in the required ratio.

In addition, as alloying element is removed from the volume to the surface of slightly soluble anode and then into electrolyte, diffusion limitations increase and element removal rate decreases, while the change in diffusion rate is different for different elements since the rate of diffusion from the surface layers of anode of the elements the concentration of which increased after the oxidation, at the initial moment of time, of the elements with the highest oxygen affinity and the most negative electrochemical potential gradually begins to increase. As a result of this non-stationary process, concentration of alloying elements in cathode aluminum changes, which is an obstacle to obtaining a multi-component aluminum alloy of stable, predetermined composition.

Thus, the more alloying elements there are in the resulting aluminum alloy, the more difficult it is to find anode composition and electrolysis conditions which will ensure production of aluminum alloy of target composition. Therefore, this method has a limitation in terms of resulting alloys and it can only be used to get alloys with a small amount of alloying elements with unstable composition.

The objective of the proposed invention is to simplify the technology and control, reduce consumption of master alloy, and as a result, to reduce the cost of aluminum alloy production. Thus, we are talking about production of multicomponent aluminum alloys of a given composition with introduction of alloying admixtures in the process of aluminum production by electrolysis followed by bringing the alloy to a given composition. An advantage of the invention is a production of aluminum alloys with reduced consumption of master alloy containing alloying elements.

To solve the problem and achieve the specified result, a method for producing aluminum-based alloys by electrolysis was proposed, in which low-consumable anode of aluminum pot is used as a source of alloying elements, and one of the following is chosen to reduce master alloy consumption:

- dissolving alloying elements from slightly soluble anodes,
- adding oxides and/or fluorides and/or carbonates of alloying elements to electrolyte melt of aluminum pot,
- simultaneous dissolving of alloying elements from slightly soluble anodes with addition of oxides and/or fluorides and/or carbonates of alloying elements to electrolyte melt of aluminum pot.

The method comprises the following steps:

- introduction of alloying elements into molten cathode aluminum by dissolving them in electrolyte melt of aluminum pot from low-consumable anode and/or by adding alloying elements to electrolyte melt of aluminum pot,
- reduction of alloying elements introduced into electrolyte melt of aluminum pot on molten cathode aluminum, obtaining the base for aluminum alloys,
- determination of percentage of elements in the base for aluminum alloys, and
- bringing alloys to a given composition by adding alloying elements to the base for aluminum alloys in the required amount.

The main feature of the proposed solution is an introduction of part of alloying elements into molten cathode aluminum by dissolving them in electrolyte melt of aluminum pot from slightly soluble anode, and/or by adding oxides and/or fluorides and/or carbonates of alloying elements into electrolyte melt of aluminum pot, which can be carried out simultaneously; then reduction of alloying elements introduced into electrolyte melt of aluminum pot on molten cathode aluminum obtaining the base for aluminum alloys, measuring elements concentration in electrolyte and aluminum poured from the pot, which is the base for aluminum alloys, controlling feed rate of oxides and/or fluorides, and/or carbonates of alloying elements, calculating the required amount of elements to produce aluminum alloys of a given composition, and bringing alloys to a given composition by adding calculated required amount of alloying elements to the base.

In this case, it is advisable to use oxide-fluoride melts as electrolyte; metal alloy can be used as a low-consumable anode; determination of elements percentage in the base for aluminum alloys should be preferably carried out by analytical methods.

Introduction of oxides and/or fluorides and/or carbonates of alloying elements into electrolyte melt is carried out periodically at a rate necessary to ensure constant concentration of alloying elements in electrolyte and in aluminum. Feed rate is adjusted according to the results of analysis of concentration of alloying elements in the electrolyte and the aluminum: with decrease in concentration, feed rate is increased, and with increase in concentration, feed rate is reduced.

Powdered chemical compounds of alloying elements are commonly used. The need to use oxides, fluorides, and carbonates is explained by the fact that when they are introduced into electrolyte melt, the electrolyte melt remains oxyfluoride, i.e. basic component composition remains constant. Consequently, electrolyte properties change a little, which is very important for maintaining a stable technology for aluminum production by electrolysis. For introduction of such powdered chemical compounds of alloying elements into electrolyte melt, feeders that feed alumina powder into electrolyte can be used. Feed can be carried out through a separate feeder or in the form of a mixture of alumina and oxides and/or fluorides and/or carbonates of alloying elements. Feed rate is adjusted by analyzing the concentration of alloying elements in electrolyte and aluminum. With decrease in concentration, feed rate is increased, and with increase in concentration, feed rate is reduced.

Reduction of alloying elements on aluminum cathode can occur both as a result of a direct electrochemical reduction reaction of alloying elements dissolved in molten electrolyte, and as a result of their chemical reduction by aluminum from the electrolyte melt.

Alternative implementations of the proposed method are possible, where the stage of introduction of alloying admixtures into electrolyte melt is as follows:

1. Dissolving alloying elements from slightly soluble anodes.
2. Adding oxides and/or fluorides and/or carbonates of alloying elements to electrolyte melt of aluminum pot.
3. Simultaneous dissolving of alloying elements from slightly soluble anodes and addition of oxides and/or fluorides and/or carbonates of alloying elements to electrolyte melt of aluminum pot.

In essence, an optimal method for producing aluminum alloys on inert anodes has been proposed. The novelty of the method lies in the fact that for the production of aluminum alloy, not only additives to the anode are used, as in the prototype, but also additives to electrolyte. Alloy component which cannot be added to inert anode is added to electrolyte. Alternatively, it is possible to add to electrolyte the same element that is in the anode. Thereby, an alloy is produced, and anode consumption is reduced.

SHORT DESCRIPTION OF DRAWINGS

FIG. 1 shows a diagram of the most well-known and widely used process for producing aluminum alloys from electrolytic aluminum.

A5, A7 or A85 aluminum grades are obtained in pot with carbon anodes. The resulting aluminum is pumped out of the pot, poured into alloying furnace, where aluminum is mixed with master alloys, which contain alloying admixtures with X1, X2, X3, . . . concentrations. Type and amount of master alloy is determined depending on target composition of aluminum alloy.

Figure 2:
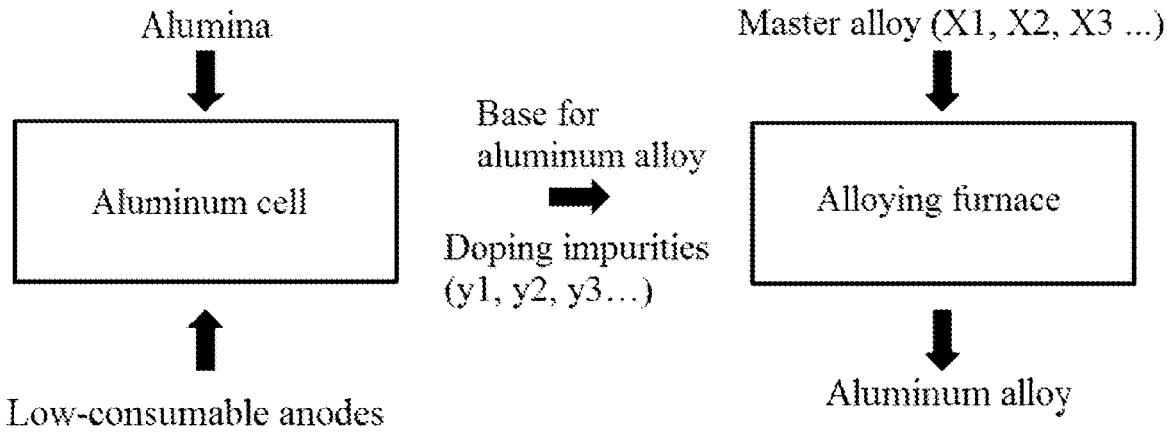

FIG. 2 shows a diagram of the first option of the proposed method for production of aluminum alloys.

We are talking about the option of introducing alloying elements into molten cathode aluminum by dissolving them in molten electrolyte of aluminum pot from low-consumable anode. The diagram differs from the diagram in FIG. 1 by the fact that during electrolysis, instead of carbon anodes, low-consumable anodes are used, from which in the course of electrolysis alloying admixtures contained in the anode enter the aluminum. The diagram of the method in FIG. 2 differs from the method in the prototype by presence of the stage for measuring Y1, Y2, Y3, . . . concentrations of alloying admixtures in the resulting aluminum (base for aluminum alloys) and the stage of bringing the base to a predetermined alloy composition. At the last stage, the base for aluminum alloys is poured into alloying furnace and then mixed with master alloys containing alloying admixtures with X1, X2, X3, . . . concentrations. Type and amount of master alloy are determined depending on the target composition of aluminum alloy, taking into account difference between the target concentration of each alloying element in aluminum alloy and its concentration in the base for aluminum alloy.

Figure 3:
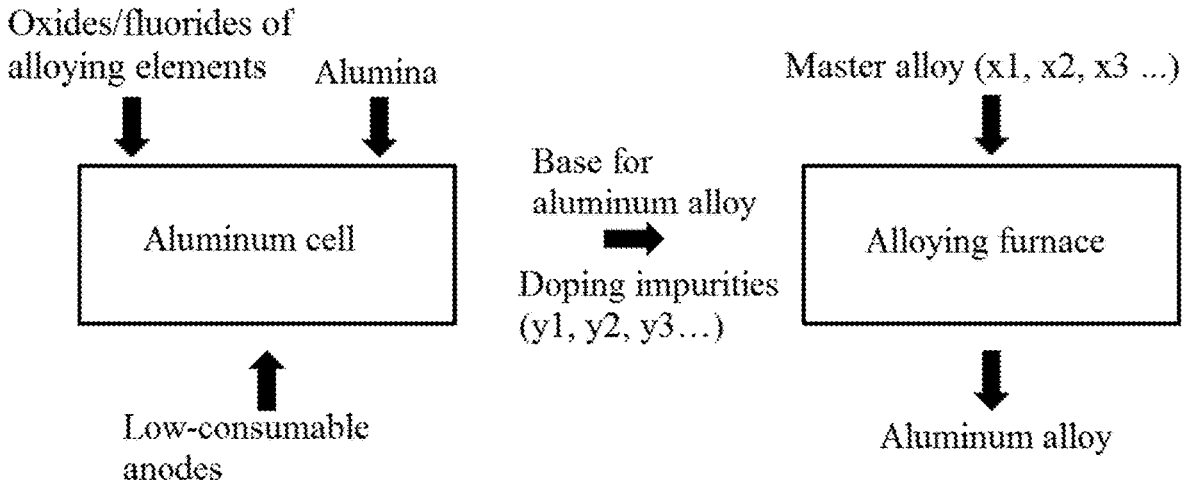

FIG. 3 shows a diagram of another option of the proposed method for producing aluminum alloys.

We are talking about the option of introducing alloying elements into molten cathode aluminum by dissolving them in electrolyte melt of aluminum pot from low-consumable anode and by adding oxides and/or fluorides and/or carbonates of alloying elements into electrolyte melt of aluminum pot. The diagram differs from the diagram in FIG. 2 by the fact that during electrolysis, oxides/fluorides or carbonates of alloying elements are introduced into electrolyte of aluminum pot, which are then transferred to the base for aluminum alloys together with alloying elements from a low-consumable anode. In this case, additional operations are the measurement of concentration of alloying elements in electrolyte and the adjustment of feed rate of oxides and/or fluorides and/or carbonates of alloying elements to maintain their stable concentration in electrolyte and the base for aluminum alloys. The rest of the scheme is similar to the scheme in FIG. 2

DETAILED DESCRIPTION OF THE ESSENCE OF THE INVENTION

In contrast to the known method for producing alloys, the diagram of which is shown in FIG. 1, the proposed method involves obtaining alloys in several stages. Options of the proposed method shown in FIG. 2 and FIG. 3 allow to obtain the desired concentration of alloying elements as follows: at the first stage, in the pot the alloying elements are transferred from slightly soluble anode to aluminum cathode with Y1, Y2, Y3, . . . concentrations in aluminum; at the second stage, Y1, Y2, Y3, . . . concentrations are measured, required weights of alloying elements are calculated to adjust to the target concentration, and the calculated weights of alloying elements (both introduced into the aluminum during electrolysis and others needed to obtain alloys of a given composition) are added to the resulting aluminum in alloying furnace.

Compared with the existing method of aluminum alloys production by alloying primary aluminum with master alloys, the proposed method makes it possible to reduce involvement of master alloy containing alloying elements. Reduction of master alloy consumption for production of aluminum alloy by partially alloying aluminum by dissolving anode material and/or adding alloying element compounds to aluminum pot will reduce the cost of production of aluminum alloy, since the cost per weight unit of alloying element included in anode or added compounds of alloying elements is significantly lower than the cost per weight unit of alloying element in master alloy. For example, the cost per weight unit of silicon in quartz sand is 2.5-3 times less than the cost of silicon in AlSi50 master alloy (as of 2015).

In contrast to the analogs and the prototype, any of alternative options of the proposed method for producing aluminum alloys provides for determination of percentage of elements in the base for aluminum alloys and further bringing of alloys to a given composition by adding alloying elements to the base. This ensures production of aluminum alloys of stable and desired composition. In addition, the choice of anode composition is simplified, since there is no need to achieve a compromise between anode wear rate and the need to add to anode composition the alloying elements that increase anode corrosion rate.

This allows to use the most resistant anodes and, consequently, reduce their consumption. Also, due to inclusion in the aluminum alloys production method of the stage of bringing alloys to a given composition, the need for strict control over parameters of electrolysis process is eliminated, since in the event of a change in the composition of the base of aluminum alloy due to possible technological deviations, the amount of alloying elements added to the alloy base will be adjusted accordingly when the alloy is brought to a given composition. This simplifies electrolysis process.

Thus, the task of reduction of the cost of aluminum alloy production is solved by reducing consumption of master alloy containing alloying elements and reducing the cost of production of base for aluminum alloy.

Comparison of the proposed solution with the closest analogue revealed the following differences.

In one option of implementation of the proposed method, the feed oxides/fluorides/carbonates of alloying elements into aluminum pot is used as a source of alloying elements. Aluminum alloy is received in several stages:

- introduction into molten cathode aluminum of alloying elements by dissolving them in electrolyte melt of aluminum pot from low-consumable anode and/or adding oxides/fluorides/carbonates of alloying elements to electrolyte melt of aluminum pot,
- reduction of alloying elements, introduced into electrolyte melt of aluminum pot on molten cathode aluminum, obtaining the base for aluminum alloys, determination of percentage of elements in the base for aluminum alloys, and bringing alloys to a given composition by adding alloying elements to the base for aluminum alloys in the required amount.

In one option of the method of aluminum alloys production, i.e. when oxides and/or fluorides and/or carbonates of alloying elements are added to electrolyte melt of aluminum pot, chemical compounds of several different elements are added to electrolyte melt, which ensures production of multicomponent alloys, in contrast to the known methods for producing aluminum alloys by adding oxides of only one of alloying elements into electrolyte melt. In addition, unlike the analogs and the prototype, by controlling concentration of admixtures in electrolyte and aluminum, a more stable concentration of added alloying elements in the base for aluminum alloys is provided for a long time.

In another option of the method of aluminum alloys production, i.e. while simultaneously adding oxides and/or fluorides and/or carbonates of alloying elements to electrolyte melt of aluminum pot, anode consumption decreases as compared to the prototype, since concentration gradient of elements in the electrolyte volume and anodic layer of the electrolyte is decreased.

Combination of features that characterize the proposed method allows to obtain multicomponent alloys of a given and stable composition, reduce consumption of master alloy containing alloying elements, and also to reduce consumption of slightly soluble anodes and simplify the electrolysis technology and, due to this technical effect obtained with the help of the claimed method, to produce aluminum alloys at lower cost as compared to the known technology.

Implementation of the Invention

The proposed method is implemented as follows.

Example 1

Dissolution of Alloying Elements from Slightly Soluble Anodes

For testing the proposed method of aluminum alloys production, at the first and the second stages alloys were prepared using aluminum electrolysis in the pot, current 3 kA. A low-consumable anode of the following composition (wt. %) was used: Fe—65, Cu—35, and the electrolyte used was of the following composition (wt. %): NaF—43, $CaF_2$—5, $Al_2O_3$—5, $AlF_3$—47. At the next stage, periodically taken cathode aluminum samples were sent to optical emission analysis, the results of which were used to calculate master alloy weight to bring the alloy base to the required chemical composition of 8011 aluminum alloy containing the following elements (in wt. %):

Silicon: 0.5-0.9
Iron: 0.6-1.0
Copper: up to 0.1
Manganese: ≤0.2
Magnesium: ≤0.05
Chrome: ≤0.05
Zinc: ≤0.1
Titanium: ≤0.08
Other admixtures in total: ≤0.15%

Calculation of master alloy consumption for the proposed method of aluminum alloy production is given in Table 1. Pouring was carried out once every three days. After measuring iron and silicon concentration in the aluminum on ARL optical emission spectrometer, we calculated AlFe80 and AlSi50 master alloy weight and brought the alloy to the composition of 8011 aluminum alloy by adding the calculated amount of master alloys to the base.

TABLE 1

| Time after start of the experiment, days | Alloy bays production stage | | | 8011 alloy production stage | |
|---|---|---|---|---|---|
| | Weight Al, kg | Fe, % | Si, % | AlFe80 master alloy consumption, kg | AlSi50 master alloy consumption, kg |
| 50 | 68.1 | 0.617 | 0.05 | 0.165 | 0.890 |
| 53 | 68.5 | 0.611 | 0.05 | 0.172 | 0.895 |
| 56 | 68.2 | 0.604 | 0.05 | 0.177 | 0.891 |
| 59 | 69.5 | 0.682 | 0.05 | 0.112 | 0.908 |
| 62 | 65.4 | 0.638 | 0.05 | 0.142 | 0.855 |
| 65 | 69.2 | 0.611 | 0.05 | 0.173 | 0.904 |
| 68 | 67.3 | 0.601 | 0.05 | 0.177 | 0.879 |
| 71 | 66.8 | 0.598 | 0.05 | 0.178 | 0.873 |
| 74 | 68.7 | 0.596 | 0.05 | 0.185 | 0.898 |

Average consumption of AlFe80 master alloy according to the proposed method was 2.4 kg per ton of aluminum.

In the production of 8011 alloy using the known method (alloying of graded aluminum in alloying furnace), when using A7 aluminum as a raw material, consumption of AlFe80 master alloy is 9.4 kg per ton of aluminum.

Thus, as a result of use of the proposed method, aluminum alloy with lower consumption of AlFe80 master alloy was obtained as compared to the known method for producing alloy by adding AlFe80 master alloy to graded electrolytic aluminum, namely, saving of AlFe80 master alloy in production of 8011 aluminum alloy was 7 kg/t.

Consumption of AlSi50master alloy in the proposed and known method is the same. In addition, it can be seen that it is impossible to produce 8011 alloy at the first and the second stages, i.e. the method of the prototype does not allow to solve the technical problem.

Example 2

Simultaneous Dissolution of Alloying Elements From Slightly Soluble Anodes and Adding Oxides and/or Fluorides and/or Carbonates of Alloying Elements to Electrolyte Melt of Aluminum Pot To test the proposed method of aluminum alloys production, at the first and the second stages the base for alloys was obtained by aluminum electrolysis in the pot, current 3 kA. In this case, a slightly soluble anode of the following composition (wt. %) was used: Fe—65, Cu—35, and the electrolyte used was of the following composition (wt. %): NaF—43, $CaF_2$—5, $Al_2O_3$—5, $AlF_3$—47. Silicon oxide was fed into the pot, flow rate 340 grams per day.

Electrolyte and aluminum samples were analyzed daily for silicon content with the help of PANalytical MagiX X-ray fluorescence spectrometer and ARL optical emission spectrometer, which was maintained at 800 ppm and 8000 ppm, respectively. Since these values were stable during the electrolysis, and silicon concentration in the base for aluminum alloy corresponded to its target concentration in 8011 alloy, consumption of silicon oxide in the electrolysis process was not adjusted.

At the next stage, samples of periodically extracted cathode aluminum were sent for optical emission analysis. Pouring was done once every three days. After measuring iron and silicon concentration in aluminum, we calculated AlFe80 master alloy weight and brought the alloy to the composition of 8011 aluminum alloy by adding the calculated amount of master alloy to the base. Calculation of master alloy consumption in this option of the proposed method of producing aluminum alloy is shown in Table 2.

TABLE 2

| Time after start of the experiment, days | Alloy base production stage Al weight, kg | Fe, wt. % | 8011 alloy production stage AlFe80 master alloy consumption, kg |
|---|---|---|---|
| 80 | 67.4 | 0.589 | 0.187 |
| 83 | 68.5 | 0.594 | 0.186 |
| 86 | 68.2 | 0.583 | 0.195 |
| 89 | 69.1 | 0.571 | 0.208 |
| 92 | 66.4 | 0.579 | 0.193 |
| 95 | 68.3 | 0.567 | 0.209 |
| 98 | 68.6 | 0.551 | 0.224 |
| 101 | 69.7 | 0.548 | 0.230 |
| 104 | 66.4 | 0.549 | 0.218 |

As a result of application of the proposed method, aluminum alloy was obtained with Fe content in the range of 0.62%-0.72%, and Si, in the range of 0.78%-0.84%. Average consumption of AlFe80 master alloy in the proposed method was 3 kg per ton of aluminum.

As a result of application of the proposed method, aluminum alloy was obtained with lower master alloys consumption as compared to the known method of alloy production by adding master alloys to grade electrolytic aluminum, namely, saving of AlFe80 master alloy in production of 8011 aluminum alloy was 7.2 kg/t, and saving of master alloy AlSi50 was 13 kg/t. In addition, it can be seen that it is impossible to produce 8011 alloy at the first and the second stages, i.e. the method of the prototype does not allow to solve the technical problem.

Example 2 can also be an example of implementation of the second option of the proposed method of aluminum alloys production, since when using a carbon anode instead of a low-consumable anode in the electrolysis process (at the first and the second stages of the process), silicon from silicon oxide added to electrolyte will be added to the base for aluminum alloy and iron concentration in the base will correspond to graded aluminum. Therefore, in this option of the proposed method of 8011 aluminum alloy production, only saving of AlSi50 master alloy in the amount of 13 kg/t will be achieved. To save AlFe80 master alloy, it is necessary to add iron oxides/fluorides or carbonates to electrolyte at the stage of production of the base for aluminum alloy.

The above individual implementation options of the invention are not the only possible. Various modifications and improvements are allowed, without departing from the scope of the invention as defined by the claims.

The invention claimed is:

1. A method of aluminum-based alloys production by electrolysis, according to which a low-consumable anode of an aluminum pot is used as a source of alloying elements characterized in that the method includes the following stages:

introducing the alloying elements into an electrolyte melt of the aluminum pot by dissolving the alloying elements simultaneously from the low-consumable anode and from at least one of oxides, fluorides, and carbonates of the alloying elements added to the electrolyte melt of the aluminum pot, reducing the alloying elements introduced to the electrolyte melt of the aluminum pot on a molten cathode aluminum, obtaining a base for the aluminum-based alloys, determining a percentage of the alloying elements in the base for the aluminum-based alloys, and bringing the aluminum-based alloys to a given composition by adding the alloying elements in a form of master alloys to the base for the aluminum-based alloys in the required amount, wherein introducing the alloying elements into the electrolyte melt is carried out periodically at a feed rate that ensures constant concentration of each of the alloying elements in the electrolyte melt and in the aluminum-based alloy.

2. The method according to claim 1, wherein an oxide-fluoride melt is used as an electrolyte for the electrolyte melt.

3. The method according to claim 1, wherein a metal alloy is used as the low-consumable anode.

4. The method according to claim 1, wherein determining the percentage of the alloying elements in the base for the aluminum-based alloy is carried out by analytical methods.

5. The method according to claim 1, wherein the feed rate is adjusted according to an analysis of concentrations of the alloying elements in at least one of the electrolyte melt and the aluminum-based alloy, wherein:

with a decrease in concentration of at least one of the electrolyte melt and the aluminum based alloy, the feed rate is increased, and with an increase in concentration of at least one of the electrolyte melt and the aluminum-based alloy, the feed rate is reduced.

* * * * *